United States Patent [19]

Tomono et al.

[11] 4,006,987

[45] Feb. 8, 1977

[54] APPARATUS FOR CLEANING A RESIDUAL TONER ON AN ELECTROSTATIC RECORDING MEDIUM

[75] Inventors: Makoto Tomono; Ken Nakamura; Koichi Yamakawa, all of Hachioji, Japan

[73] Assignee: Konishiroku Photo Industry Co., Ltd., Tokyo, Japan

[22] Filed: Nov. 6, 1974

[21] Appl. No.: 521,396

[30] Foreign Application Priority Data

Nov. 12, 1973 Japan ..... 48-126220

[52] U.S. Cl. ..... 355/15; 15/1.5 R; 15/256.52

[51] Int. Cl.[2] ..... G03G 21/00

[58] Field of Search ..... 15/1.5, 256.5, 256.51, 15/256.52; 355/3 DD, 15; 134/1; 118/637

[56] References Cited

UNITED STATES PATENTS

| | | | |
|---|---|---|---|
| 3,580,673 | 5/1971 | Yang | 355/15 |
| 3,713,736 | 1/1973 | Sargis | 355/15 |
| 3,780,391 | 12/1973 | Leenhouts | 15/1.5 |
| 3,792,925 | 2/1974 | Milligan | 15/256.52 |
| 3,884,572 | 5/1975 | Bacon et al. | 355/15 |

*Primary Examiner*—Edward L. Roberts
*Attorney, Agent, or Firm*—Bierman & Bierman

[57] ABSTRACT

Apparatus for cleaning residual toner from an electrostatic recording medium is provided wherein a brush is located adjacent the medium and a toner seizer is located adjacent the brush to remove toner carried by the brush.

9 Claims, 3 Drawing Figures

APPARATUS FOR CLEANING A RESIDUAL TONER ON AN ELECTROSTATIC RECORDING MEDIUM

The present invention relates an apparutus for cleaning residual toner, after transfer on an electrostatic recording medium being repeatedly used, and especially relates to a cleaning apparatus utilizing a so-called magnetic brush.

In general xerography an electrostatic latent image is formed on a support member (thereafter referred to as photosensitive plate) having a photoconductive insulating layer by utilizing known means of charging and exposure. A developer in with the surface of the latent image is used to make a toner image by utilizing developing means, toner image is then electrostatically transferred to a support member (hereafter referred to as transfer paper) such as conventional paper, and finally the toner image is fused and fixed on the transfer paper by utilizing heating means to obtain the copy. However, it is very difficult to transfer the toner image formed on the photosensitive plate to the transfer paper with efficiency of 100%, and after the process of transfer it is common to find residual toner on the surface of the photosensitive plate. If the photosensitive plate in such a situation is used for another copying operation, no charging operation is provided at the portion in which the residual toner is located. Thus, the desired picture can not be obtained due to spot production in the picture after development.

The present invention provides a cleaning process for removal of residual toner from photosensitive plate after the transfer process.

Some of the following methods for such cleaning are known;

1. a method of using a fur brush or an artificial fiber brush,
2. a method of using a web to romove toner,
3. a method of using cleaning beads cascaded onto the surface to be cleaned,
4. a method of using a magnetic brush.

However, the above methods have following disadvantages.

1'. In the method of using a fur brush or an artificial fiber brush, a high cleaning effect is obtainable only during initial use of the method. The cleaning effect is decreased in proportion to the number of times it is used because of increasing amounts toner attached at the fur brush. The number of commercially useful operations is about twenty thousand as a limit. The further disadvantage is that in the case of using such brushes in a high-speed copying machine, toner removed from the photosensitive plate scatters and soils the machine. Further, it is necessary for this method to use a vacuum device and a filter bag and the like, thus resulting in making the copy machine bulky.

2'. In the method of using a web moving and contacting the surface of the photosensitive plate, a sufficient cleaning effect is obtainable generally by contacting the new surface of the web with the surface of the photosensitive plate; however, in the case of using this method in the high-speed copy machine it is necessary to increase the feeding speed of the web or the contact pressure of the web to the photosensitive plate. This method has the disadvantage of making the machine complex and bulky.

3'. The method of using cleaning beads is known from U.S. Pat. No. 2,484,782. In this method residual toner is removed by the electrostatic force of the cleaning beads. A sufficient cleaning effect is obtainable when the cleaning beads are new. After substantial use, the surface of the cleaning beads is covered with the toner powder, resulting in deterioration of the cleaning effect. Durability of the cleaning beads is limited to within a few thousand copy cycles. As separation of the cleaning beads and toner is very difficult, degraded beads must be exchanged with new cleaning beads.

4'. The method of using a magnetic brush comprising magnetic particles is known from Japanese Patent Publication No. 41-14069. In this method, a bias voltage is impressed on the magnetic brush with the aim of controlling cleaning ability. In contrast with the cascade method above mentioned, this method has advantages in that the control of the bias voltage is easy, a good cleaning effect being obtainable for almost all kinds of photosensitive plates. However, durability of the cleaning brush is limited heretofore because no effective means for seperation of toner attached to the magnetic particles have been devised.

The present invention belongs to the above mentioned cleaning method using a magnetic brush.

An object of the present invention is to provide a residual toner cleaning apparatus having excellent cleaning ability over a long time.

Embodiments of the present invention are explained with reference to the drawings hereinafter.

Figure 1:
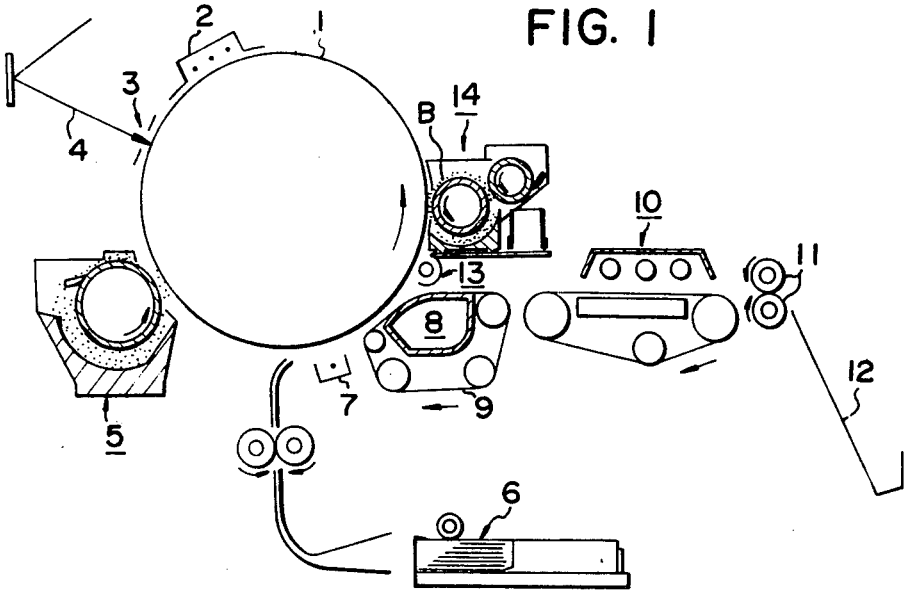
FIG. 1 shows an electrophotographic copying machine providing with an embodiment of the present invention.
Figure 2:
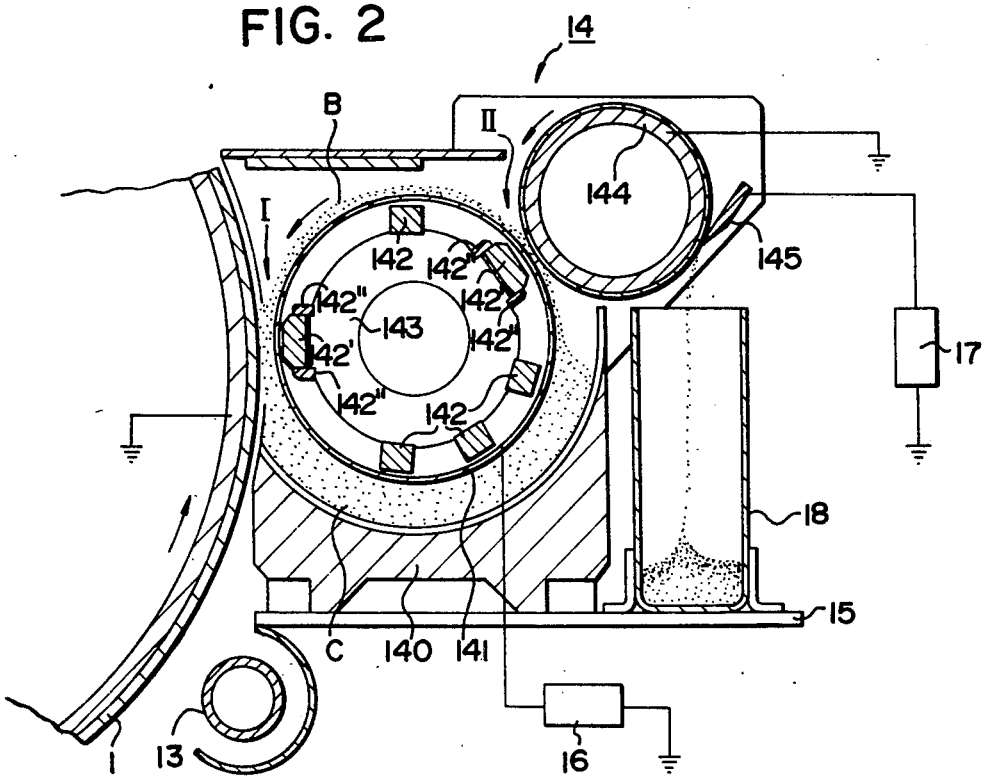
FIG. 2 is a partial enlarged view of FIG. 1.

First, a electrophotographic copying process is briefly explained hereinafter. When a drum 1 having a photosensitive plate comprising a zinc oxide dispersed in an insulating resin binder begins to rotate in the arrow direction, a charging electrode 2 begins to corona-discharge and the surface of the drum 1 is uniformly charged. Then, an imaging beam reflected from an original impinges through a slit exposure station 3 on the drum 1, whereby the electric charge on the drum 1 is suitably discharged to obtain an electrostatic latent image. Then, a developing means of the magnet brush type is actuated to obtain a toner image from the latent image by contacting developer thereto. Next, a transfer paper 6 fed synchronously with the copying operation passes on a transfer electrode 7 in such manner that the transfer paper 6 is superposed on the surface of the toner image and, the toner image is sequentially transferred to the transfer paper 6 by the corona discharge of the electrode 7. Thereafter, the transfer paper 6 is separated from the drum 1 by the suction power of a suction means 8, and is fed to a fixing means 10 by means of an endless belt 9 running in the clockwise direction at the outer side of the suction means 8. The toner on the transfer paper 6 is fused and fixed thereon by a conventional heat source, then the transfer paper 6 is issued to a tray 12 located outside of the machine by an exit roller 11 to obtain the copy. On the other hand, after transferance, the photosensitive plate carrying toner which was not transferred to the transfer paper 6 reaches the position of cleaning means 14 in a state such that the toner is attached on the drum 1 non electrically due to the discharge of the imagewise electric charge via the illumination of a lamp 13. Then, the toner is swept off the drum by means of a layer B (magnetic brush) comprising magnetic particles and rotating in contact with the drum 1. The detailed construction of the cleaning means 14 is shown in FIG. 2. Since the numerals 1, 13, and 14 in the drawing are same parts as that shown in the FIG. 1, the explanation thereof is omitted. Numeral 140 denotes a receptacle for the magnetic particles being fixedly mounted on a supporting plate 15 of a frame. Inside of the basic body, a substantially circular-arc recess for storing magnetic particles C is formed. Numeral 141 denotes a cylindrical sleeve mounted on a side wall (not shown) of the basic body so as to be able to rotate in the arrow direction, and it is connected to a terminal of a bias voltage source 16. (In this case, it is a minus terminal since the electric charge of the residual toner is plus.) The applied voltage of about −100 to −500 V is preferable, and the range of about −150 to −350 V is optimum. Numerals 142, 142' and 142'' are permanent magnets being held in a fixed core 143 where they are adjacent to the inner surface of the sleeve 141. It is unnecessary to dispose the parmanent magnets through the entire inner surface of the sleeve 141. In operation thereof, it is well enough to hold the magnetic particles C (so as to make magnetic brush B), therefore the preferable arrangement of the magnetic poles is such that the N pole and the S pole are alternately disposed. The magnets 142' are disposed at the portions I and II where the magnetic brush B contacts with the drum 1 and a toner removing roller 144, the magnets 142'' being attached respectively at both side of the magnets 142''. The magnents 142'' having a comparatively small magnetic flux density and an inverse polarity to that of the magnets 142'. By such a construction, the portions I and II of the magnetic brush are projected in comparison with the circumference thereof, and the magnetic particles are maintained in standing upright state. In other words, the magnetic brush is soft, so that the magnetic brush does not hurt the photosensitive plate and the preferred cleaning effect can be obtained. On the other hand, since the magetic brush B contacts with the toner removing roller 144, the electric charge due to triboelectricity on the surface of the roller 144 is increased, consequently the toner on the magnetic particles can be easily removed. The toner removing roller 144 comprises a conductive metal cylinder and an insulating layer such as polytetrafluoroethylene coated thereon, the roller being rotatably mounted, and the conductive metal being grounded as shown. Numberal 145 denotes a scraper made of a conductive metal and disposed in contact with the surface of the roller to scrape the toner attached on the surface of the toner removing roller 144. In the case of positive toner the scraper 145 also is connected to a minus terminal of an electric source 17 to apply bias voltage thereto, the as same as the sleeve mentioned above. The bias voltage of −200 −300 V is preferable. Though the scraper 145 may be held at earth potential, by applying the bias voltage, uncontrolled dispersion the toner at the point end of the scraper can be advantageously prevented in operation. A bucket 18 is mounted on the holding plate 15 for storing the toner scraped by the scraper 145.

As it is constructed as above, the residual toner electrostatically attached to the surface of the drum 1 after the transfer process loses the electric charge thereof via the lamp 13 and moves to the cleaning means 14 in such state that the toner physically is attached to the surface of the drum 1. Then, the toner is rubbed off by the magnetic brush B at the contact position 1 contacting the magnetic brush B formed on the sleeve 141, to remove tones the surface of the drum 1 as mentioned above.

The removed toner sequentially moves in the right-hand direction together with the magnetic particles in accordance with the rotation of the sleeve 141 to contact with the toner removing roller 144 at the position II. At the position II, the toner is mechanically and triboelectically attached to the surface of the roller and consequently removed. Immediately after that, the toner is scraped from the surface of the roller 144 by the scraper 145 and drops down into the bucket 18.

According to the method of the present invention, the amount of the toner attached to the magnetic particles C is restricted to less than about 0.5% even after copying copies of 50,000 sheets, and it has been verified in the experimental stage that an initially predetermined cleaning effect is maintained. As the magnetic particles, there can be used particles of an iron or an alloy or compound of an iron, cobalt, nickel and chrome, for example ferrite and magnetite.

Further, of course, it is efficient for use to provide manganese-copper-aluminium which shows ferromagnetism by conducting heat treatment thereto, or Heusler's alloy comprising manganese and copper such as manganese-copper-tin.

Further, the grain size of the magnetic particles and the distribution thereof are also an important factor. In general, the grain size within a range of about 100 – 400 mesh is desired, and the optimum distribution of the grain size is about 300 – 400 mesh in view of maintaining the softness of the magnetic brush and further the protection of the photosensitive plate in particular.

As to the interrelation between the sleeve and the parmanent magnets, in the inverse relation to the embodiment mentioned above, the sleeve may be fixed and the permanent magnets may rotate. In such case, the magnets may be preferably arranged so as to alternately locate the N pole and the S pole thereof along the entire inner surface of the sleeve. Further, the toner removing roller may also be rotated in the same direction as that of the brush at the portion where the magnetic brush contacts with the roller. The insulating material may be selected in accordance with the photosensitive plate to be used, for instance, when the photosensitive plate is a P-type semiconductor such as selenium and the like, materials obtaining positive charge by triboelectric contact with magnetic particles such as polyimide ethylcellulose inorganic glass or resin containing dyes for controlling positive charge are preferable. On the other hand, when the photosensitive plate is a N-type semiconductor such as zinc oxide, cadmium sulfide, organic polyvinylcarbazole, materials obtaining negative charge by triboelectric contact with carrier such as polytetrafluoroethylene, polyethylene, cellulose acetate, vinyl chloride and vinylidine chloride and the like are preferable. Of course, the insulating materials are not restricted to the above materials.

Figure 3:
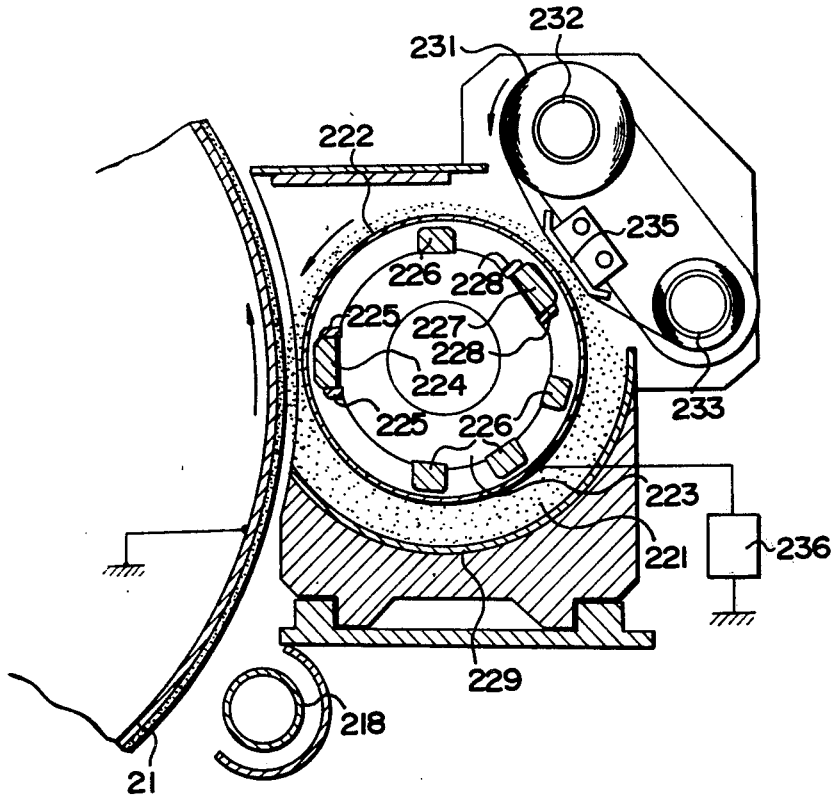
FIG. 3 shows another embodiment of the present invention.

In another embodiment shown in FIG. 3, a toner seizer mainly comprises a web of insulating material 231 and reels 232, 233 instead of the roller 144 in FIG. 2. A photosensitive plate 21, a lamp 218, magnets 224 to 228, a receptacle 229 and a sleeve 222 are respectively same as the photosensitive plate 1, lamp 13, magnets 142, 142', 142'', receptacle 140 and sleeve 141 in FIG. 2. In cleaning the residual toner off the photosensitive plate 21, the web 231 moves in the direction of the arrow and is wound on the reel 233. The web 231 is of the same resin as the insulating layer of the roller 144 in FIG. 2. The web 231 is contacted to the magnetic brush by the plate 235, so that the toner is transferred from the magnetic brush to the web 231.

Many other embodiments than those shown above are possible within the scope of the present invention. For example, the toner seizer may comprize an endless belt, rolls supporting the belt and means for sweeping a toner on the belt.

What is claimed is:

1. An apparatus for cleaning residual toner from an electrostatic recording medium comprising;

a. a plurality of magnetic particles, b. carrier means for carrying said magnetic particles thereon, said carrier means being spaced a selected distance from said electrostatic recording medium, said selected distance being small enough to permit contact of said magnetic particles with said electrostatic recording medium;

c. means for applying a bias potential between said electrostatic recording medium and said carrier means for attracting residual toner particles to said magnetic particles;

d. a toner seizer adjacent to and spaced from said carrier means and spaced from said electrostatic recording medium for removing toner from said magnetic particles, said toner seizer being of insulating material and positioned to be contacted by said magnetic particles carried by said carrier means;

e. a plurality of magnet means within said carrier means, said carrier means and said magnet means being relatively movable with respect to each other, at least one of said magnet means being positioned adjacent said electrostatic recording medium and another of said magnet means being positioned adjacent said toner seizer.

2. Apparatus for cleaning residual toner from an electrostatic recording medium according to claim 1 wherein the magnet means positioned adjacent said electrostatic recording medium and the magnet means positioned adjacent said toner seizer are each comprised of a central magnet having a selected polarity and magnets of opposite polarity directly adjacent the flanks of the said central magnets.

3. Apparatus according to claim 1 wherein said toner seizer comprises a web of plastic resin film.

4. Apparatus according to claim 3 wherein said web is of endless form and further comprises a plurality of rollers for carrying said web.

5. Apparatus according to claim 3 wherein said toner seizer further comprises a plurality of reels for winding said web.

6. Apparatus according to claim 1 wherein said toner seizer further comprises means for scraping toner from the insulating material of said toner seizer.

7. Apparatus according to claim 6 wherein said toner seizer further comprises means for applying a bias potential to said scraping means.

8. Apparatus for cleaning residual toner from an electrostatic recording medium according to claim 1 wherein the electrostatic recording medium is a P-type semiconductor and wherein said toner seizer insulating material is selected from the group consisting of polyimide ethylcellulose inorganic glass and resin containing dyes.

9. Apparatus for cleaning residual toner from an electrostatic recording medium according to claim 1, wherein the electrostatic recording medium is made of N-type semiconductor material and wherein the toner seizer insulating material is selected from the group consisting of polytetrafluoroethylene, polyethylene, cellulose acetate, vinyl chloride and vinylidine chloride.

* * * * *